United States Patent [19]

Barnhart et al.

[11] 3,982,702

[45] Sept. 28, 1976

[54] SAND LUMP GRINDER

[75] Inventors: Donald M. Barnhart, Martinsburgh, W. Va.; James H. Carpenter, Jr., Hagerstown, Md.

[73] Assignee: The Carborundum Company, Niagara Falls, N.Y.

[22] Filed: Mar. 6, 1975

[21] Appl. No.: 556,021

[52] U.S. Cl. ..... 241/58; 241/278 R; 241/DIG. 10

[51] Int. Cl.[2] ..... B02C 7/11

[58] Field of Search ..... 241/47, 58, 277, 278 R, 241/601, DIG. 10

[56] References Cited

UNITED STATES PATENTS

| | | | |
|---|---|---|---|
| 279,067 | 6/1883 | Wolf | 241/47 |
| 801,572 | 10/1905 | Davis | 241/58 X |
| 948,129 | 2/1910 | Bilz | 241/DIG. 10 |
| 2,616,340 | 11/1952 | Knoll | 241/278 R |
| 3,552,662 | 1/1971 | Goldach | 241/DIG. 10 |
| 3,697,004 | 10/1972 | Lazar | 241/277 X |

*Primary Examiner*—Granville Y. Custer, Jr.
*Assistant Examiner*—Howard N. Goldberg
*Attorney, Agent, or Firm*—David E. Dougherty; William H. Holt

[57] ABSTRACT

Apparatus for reducing lumps of material, such as lumps of sand recovered from casting operations in metal foundries or lumps of ore and the like, including various forms of bonded abrasive grinding wheels for abrading the lumps and reducing them to particle or granular form.

20 Claims, 19 Drawing Figures

SAND LUMP GRINDER

BACKGROUND OF THE INVENTION

The invention relates to improved apparatus for reducing lumps of material to particle and granular form and, while the invention has uses in various manufacturing and mining environments, the invention will be particularly described herein with relation to use in foundries for recovering sand from molding operations and treating the sand for reuse.

In order to economically utilize the no-bake or air-set molding processes it is essential to reclaim the sand for reuse. Several methods are now used to granulate the lumps and recondition the sand. Typical methods now used include:

1. Breaking the lumps into granules by utilizing a centrifugal throwing wheel which propels particles of shot against the lumps, 2. A vibratory tub device, or a vibrating conveyor, for breaking up of lumps, 3. A sand muller which is provided with perforated holes in the bottom thereof through which the crushed sand passes, 4. A rotating propeller or paddle type mechanism is used for crushing the lumps.

All of the foregoing mentioned methods work to a greater or lesser degree. Type 1 is probably the best system in that the lumps are bombarded with millions of particles of shot, such as steel balls and the like, and this multiple impact system breaks the large lumps down into individual pieces of sand and the high velocity of the shot also removes a portion of the binder which is used during the mold forming operation to hold the grains of sand together. A disadvantage of this system is the large expense for low capacity operations. An additional disadvantage is that it will not handle large lumps, on the order of 1 foot to 3 feet, in an easy and speedy manner.

Type 2 does a reasonably good job in reducing the sand lumps to individual sand particles; however, the vibratory action does little to remove the binder from the sand particles and a greater disadvantage is the extreme wear on the tub or vibrating parts which become quickly abraded by the sand particles.

Type 3 also does little to remove the binder from the sand particles and is quite inefficient in reducing the sand to individual sand grains because the sand is forced through relatively large holes in a perforated bottom plate or pan.

Type 4 also does little to remove the binder from the sand particles and is inefficient in reducing sand to individual grains. Further, wear on the crusher blades or propellers is very high.

The present invention, in addition to overcoming undesirable features of the prior art includes the following particularly desirable features:

1. The invention provides a relatively inexpensive unit, as compared to prior art apparatus, that will reduce lumps of sand or other minerals to a granular or particulate form in a very efficient manner.

2. The main abrading element of the present invention is comprised of a highly wear resistant material, such as bonded abrasive grinding wheels and the like, which is very efficient, long lasting, and readily replaceable.

3. The improved apparatus is very efficient in reducing lumps of sand into individual sand particles or grains.

4. The present apparatus is readily suitable for handling large cubes or irregular lumps of material having dimensions on the order of 1 to 3 feet.

5. As the lumps are reduced to particle or granular size the particles form a cushion between a bonded abrasive grinding medium and the lumps which minimizes wear of the grinding medium.

SUMMARY OF THE INVENTION

The invention is particularly related to apparatus for reducing lumps of material to particles, the apparatus comprising a tub, or container, including an annular wall, an upper opening in the tub for receiving lumps of material, such as sand lumps and other ores, and a lower opening for discharging particles from the tub; and abrasive means located adjacent the lower opening of the tub for coming into rubbing, or abrading, contact with lumps of material, drive means for causing relative motion between the lumps of material and the abrasive means for abrading the lumps of material into particles, the abrasive means spaced from the annular wall for providing an exit space for allowing particles to exit from the tub, and means restricting the exit space for limiting the size of material that can pass through the exit space.

In addition, the invention relates to the provision of means for creating a flow of air through various portions of the tub for ventilating the same and for removing minute, dust-like particles of crushed material and binder.

Further, the invention relates to utilization of a conventional bonded abrasive grinding wheel for the abrasive means, the wheel being either circular, annular, segmental including pie-shaped or tile-shaped elements, and including the use of a plurality of such wheels which may be coaxially mounted, or eccentrically mounted, and which may be driven simultaneously or independently.

In addition, the invention relates to the provision of means for restricting the exit space, including a flexible curtain, or an annular ring, or a combination of both.

Still further, the invention relates to the provision of apparatus including a slinger plate for protecting bearings which are used to mount a drive spindle.

DETAILED DESCRIPTION OF THE PREFERRED EMBODIMENTS

Figure 2:
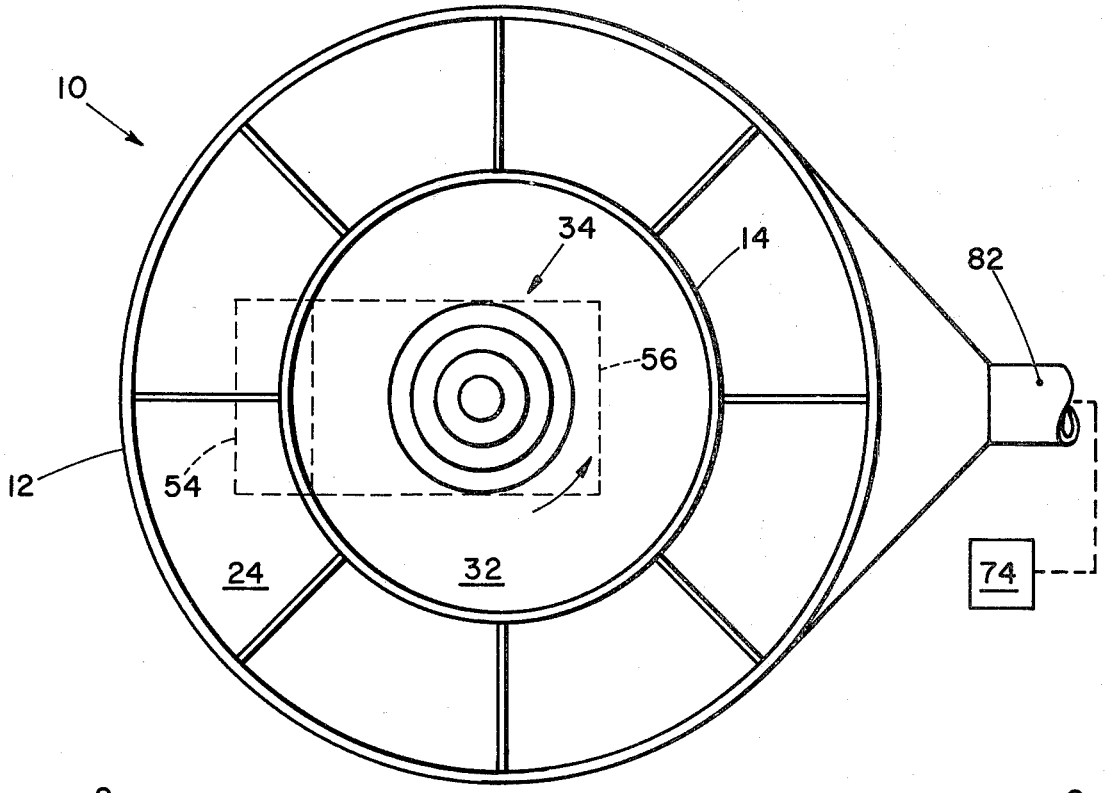
FIG. 2 is a partial plan view taken on line 2—2 of FIG. 1 and includes a diagrammatic illustration of means for creating a flow of air through the apparatus.
Figure 1:
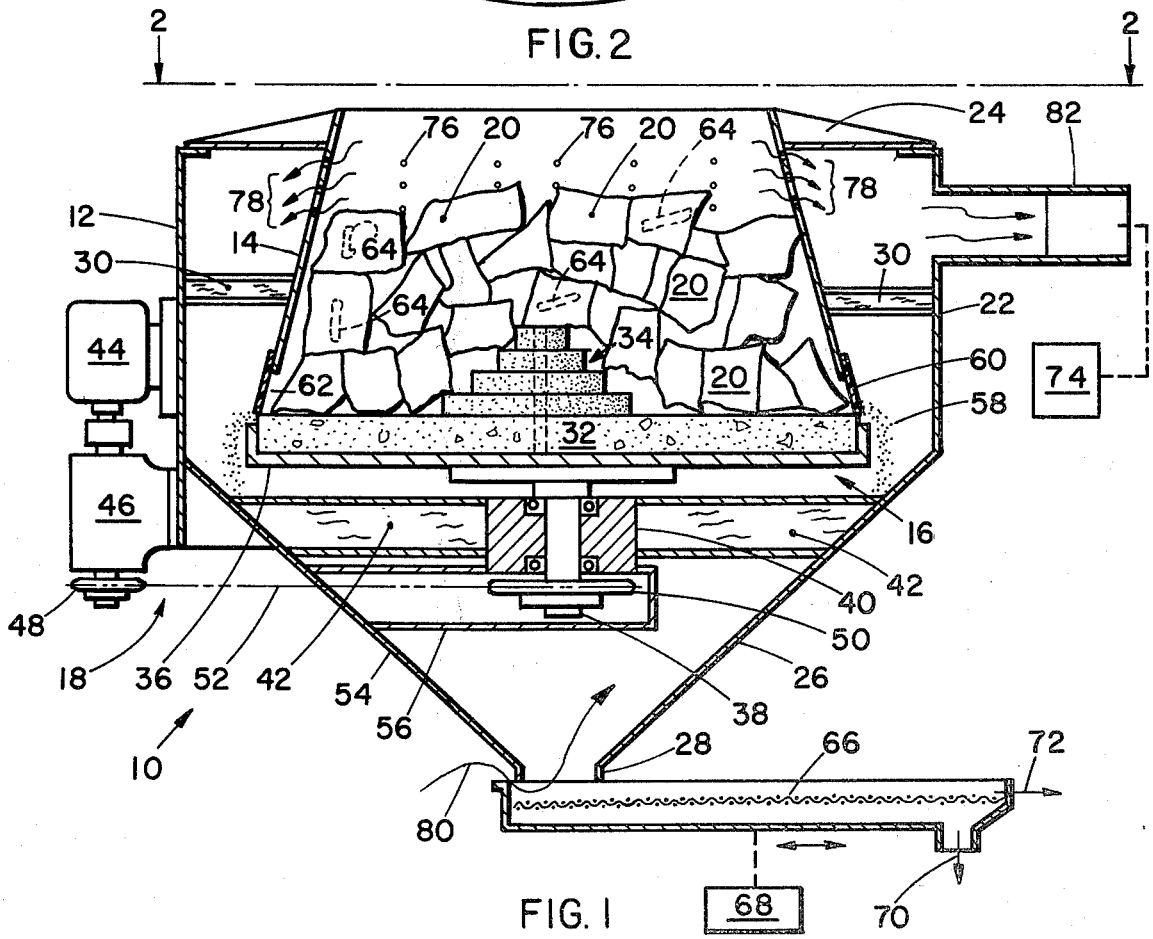
FIG. 1 is a vertical section of the improved lump grinder and shows an outer housing surrounding a stationary tub containing lumps of material which are to be reduced to particle form by a plurality of grinding wheels mounted adjacent an open lower opening of the tub, and drive means for rotating the wheels relative to the tub and outer housing.

FIGS. 1 and 2 illustrate one form of lump grinder, generally indicated by the numeral 10, which includes an outer housing 12, a tub or container 14, an abrasive grinding member generally indicated by the numeral 16, and a drive mechanism, generally indicated by the numeral 18, which rotates the abrasive member for reducing lumps of sand or ore 20 into much smaller lumps or particles.

The outer housing 12 is preferably constructed of heavy gauge metal plates or walls 22 and is provided with a top cover 24 and an inclined hopper portion 26 having a bottom opening 28. The outer housing 12 thus forms an enclosure about the tub 14.

The tub 14 is centrally mounted within the outer housing 12 by a plurality of channel shaped support members 30 which provide a spider-like support structure which may be welded or bolted to the other housing 12 and the tub 14.

The abrasive grinding member 16 is shown in FIG. 1 as being comprised of a large, circular, bonded abrasive grinding wheel 32 which has superimposed thereon a plurality of progressively smaller wheels, generally indicated by the numeral 34, the smaller wheels 34 being eccentrically mounted relative to the large grinding wheel 32. The grinding wheels 32 and 34 are shown as being supported within a support pan 36 which is fixedly secured to a drive spindle or shaft 38 carried by a bearing block 40 suitably supported from the outer housing 12 by a plurality of I-beams 42 which provide a spider-like support structure for withstanding the weight of lumps 20 which are carried by the grinding wheels 32 and 34.

The drive mechanism 18 which drives the spindle 38 and the abrasive grinding members 16 preferably includes a motor 44, a gear reducer 46 and sprockets 48 and 50 which are connected by a drive belt or chain 52 which passes through an opening 54 in the side of outer housing 12 and is shielded from debris within the housing 12 by a closed compartment 56.

It will be readily apparent from the foregoing that rotation of the abrasive grinding member 16 by the motor 44 causes the grinding wheels 32 and 34 to cause the lumps 20 to be reduced to particles or grains of sand and the like which exit in an annular stream of particles 58 extending a complete 360 degrees about a circumference of grinding wheel 32. The particles in stream 58 are moved outwardly by centrifugal force along the top surface of the grinding wheel 32 and force a flexible curtain 60 away from an exit opening 62 which is provided between the lower marginal portion of tub 14 and the grinding wheel 32. Flexible curtain 60 is preferably formed of rubber or other material which will sustain the abrasive action of the particles and functions to minimize the size of particles or quite small lumps passing through the exit opening 62. As is well known in the foundry art, lumps of sand from molds contain support rods 64; it is apparent that the flexible curtain 60 is adaptable for allowing such support 64 to also pass through exit opening 62.

As the stream of particles 58 and the support rod 64 pass downwardly through the inclined hopper portion 26 and exit through bottom opening 28, they fall upon a screen 66 which is, preferably, vibrated horizontally by a conventional vibratory mechanism 68 which causes the particles to pass through the screen 66 and exit through a bottom port in the direction of arrow 70 while the support rod 64 and small lumps exit along the direction of arrow 72. As a result, the particles of sand or other material which exits along the arrow 70 is suitable for further treatment and use.

The grinding operation performed by grinding wheels 32 and 34 creates a considerable amount of dust within the tub 14, which dust may be comprised of pulverized particles and resin binders used in molding operations, a considerable portion of such binder being removed from the individual particles of sand by the highly abrasive action of the grinding wheels 32 and 34. It is therefore desirable to provide a fan or blower, diagrammatically indicated by the box 74, for drawing air into the tub 14 and through a plurality of vent holes 76, as depicted by the arrow 78, and through the bottom opening 28 as depicted by the arrow 80. The air flow created by fan 74 thereby draws air through the vent holes 76 and bottom opening 28 and causes it to flow through an exit duct 82 and pass to a conventional dust collector (not shown) whereby, if suitable, the collected dust may be salvaged but, in any event, provides a clean working environment for operators of the lumps grinder 10, thereby greatly improving the working conditions in foundry operations.

Figure 3:
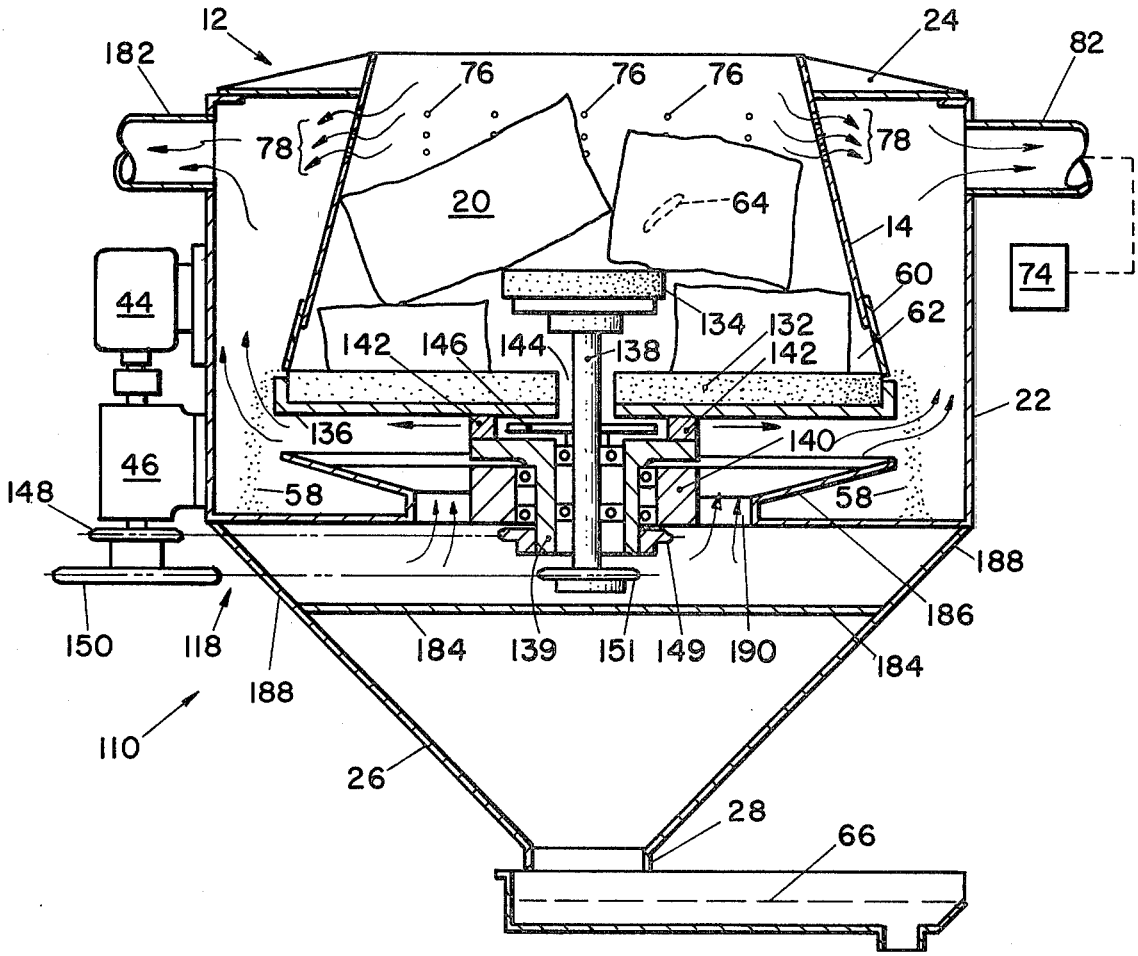
FIG. 3 is a vertical section of a modified form of the invention wherein a plurality of drive trains are provided for differentially rotating separate abrasive wheels.
Figure 4:
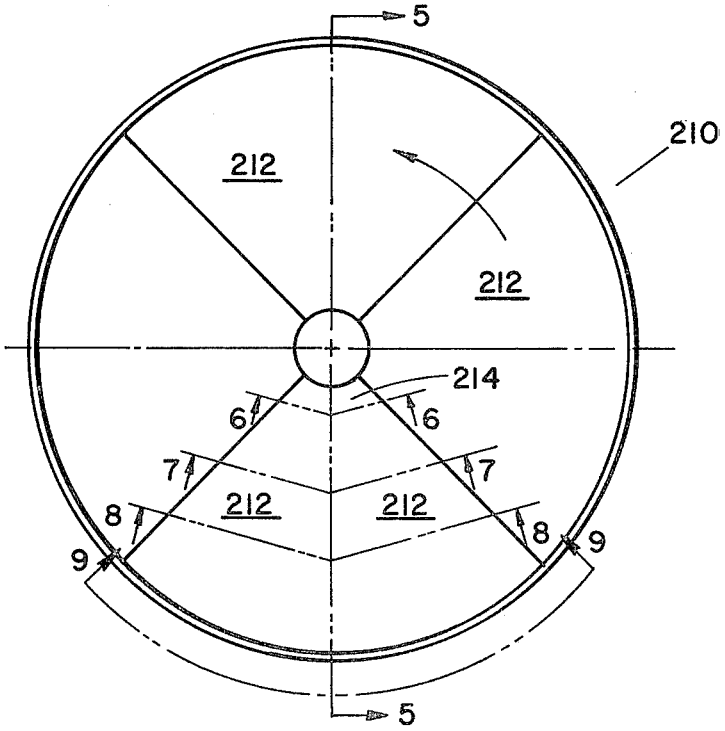
FIG. 4 is a diagrammatic plan view of one form of grinding wheel forming part of the invention.
Figure 5:
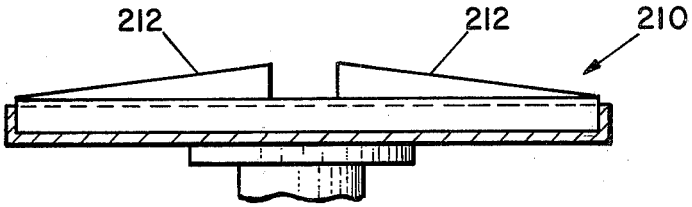
FIG. 5 is a vertical section, taken on line 5—5 of FIG. 4.
Figure 6:
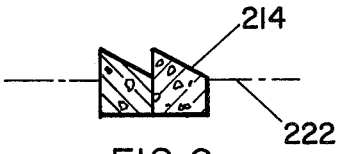
FIGS. 6–9, inclusive, are fragmentary vertical sections, taken on respective section lines of FIG. 4.
Figure 7:
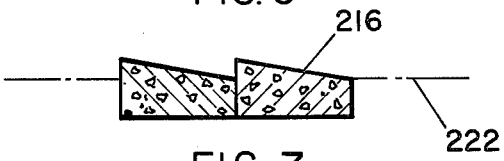
Figure 8:
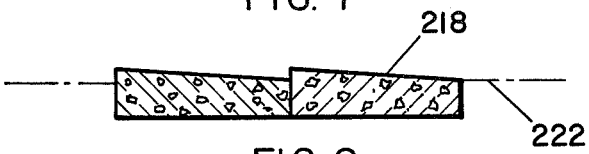

FIG. 3 illustrates a modified version of lump grinder, generally indicated by the numeral 110, wherein the same numerals are used for similar parts depicted in the embodiment of FIGS. 1 and 2. Lump grinder 110 differs from lump grinder 10 in that motor 44 and gear reducer 46 provide a differential drive mechanism, generally indicated by the numeral 118, comprised of a series of sprockets 148, 149, 150 and 151 for driving a small grinding wheel 134 by means of a drive spindle or shaft 138 and driving a large grinding wheel 132 by means of a drive collar 139 suitably carried by a bearing block 140. The grinding wheel 132 is carried by a support pan 136 which, in turn, is fixedly secured to drive collar 139 by a plurality of small, circumferentially disposed spacer blocks 142. Particles of sand and the like can pass from small grinding wheel 134 through a central opening 144 in the center of large grinding wheel 132 and fall upon a flat plate or slinger 146 which is keyed to the drive spindle 138 and functions to protect bearings 147.

Another difference between the lump grinder 110 and lump grinder 10 is that lump grinder 110 is provided with a modified ventilating apparatus wherein an additional air duct 182 is provided for more evenly distributing the flow of air into and through tub 14 and outer housing 12. In addition, lump grinder 110 is provided with a series of air intake tunnels 184 which may consist of four tunnels spaced 90° apart in order to equalize air distribution, the air tunnels 184 being connected to an annular shed roof 186 so that air passes through openings 188 and 190 through the annular stream of particles 58 for removing small particles of dust and the like and for cooling the particles in stream 58.

Figure 9:
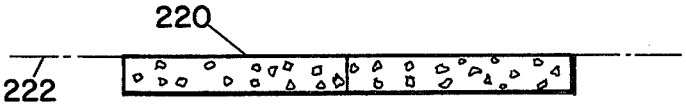

FIGS. 4–9, inclusive, illustrate the design of an abrasive member, generally indicated by the numeral 210, which is particularly useful to increase the grind rate at a central portion thereof. The abrasive member 210 may be molded in one piece or, preferably, is made up of a series of pie shaped elements 212 which extend 45° about the member 210 and are provided with a steep grinding slope 214 at the center with the slope progressively becoming smaller toward the outside diameter of the member 210 as shown by the surfaces 216 and 218, in FIGS. 7 and 8, until the slopes become a flat surface 220 at the outermost portion of the wheel as shown in FIG. 9. For ease of illustration, the respective showings in FIGS. 6–9, inclusive, are shown in conjunction with a common reference plane 222. The increased slope at the center area of the pie shaped elements 212 provides for increased pressure between the lumps and the grinding surface of the abrasive member 210 because of the forces incident to wedging the lumps up the respective sloped surfaces as the abrasive member is rotated.

In addition to the sloped surfaces of the abrasive member 210, there are other manners of increasing the grinding rate at the central portion of the abrasive grinding member. As previously pointed out in the description of the embodiment of FIGS. 1 and 2, the smaller grinding wheels 34 can be located off center of the grinding wheel 32 in order to increase the grinding rate and the smaller wheels 34 should be of a coarser grain than the main grinding wheel 32. Further, if a flat grinding surface is to be used at the center portion of the abrasive grinding member, the grinding rate can be increased at the center by making the grinding wheel rougher in the center than at its radially outward surface. Still further, on large lumps which may be cubes having dimensions of one to three feet, the rate of grind is somewhat governed by the cutting action of the center part of the wheel which, obviously, rotates slower than the outermost portion of the wheel. In order to increase the center grind rate, the embodiment of FIG. 3 illustrates that the smaller grinding wheels 134 are rotated at a higher angular velocity to give the smaller wheels 134 an average surface speed approximately equal to the average surface speed of the larger grinding wheel 132.

Figure 10:
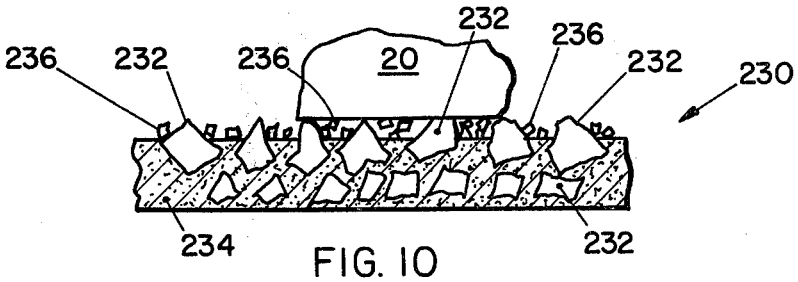
FIG. 10 is an enlarged, fragmentary view of a bonded abrasive grinding medium, such as a portion of a grinding wheel, and shows small particles of material which provide a cushion on the upper surface to minimize wear of the bond material between abrasive grains of the bonded abrasive.

FIG. 10 illustrates a fragmentary portion of a bonded abrasive grinding wheel 230 which is comprised of particles of abrasive grain 232 such as aluminum oxide or silicon carbide and the like. The abrasive grains 232 are held together by conventional bonding material 234 for forming the abrasive wheel 230. During operation of the present invention a typical lump of material 20 is reduced to a large number of individual particles 236 which become additional grinding points and also form a protective layer or cushion over the binder 234 thereby materially increasing the effective life of the grinding wheel 230.

Figure 11:
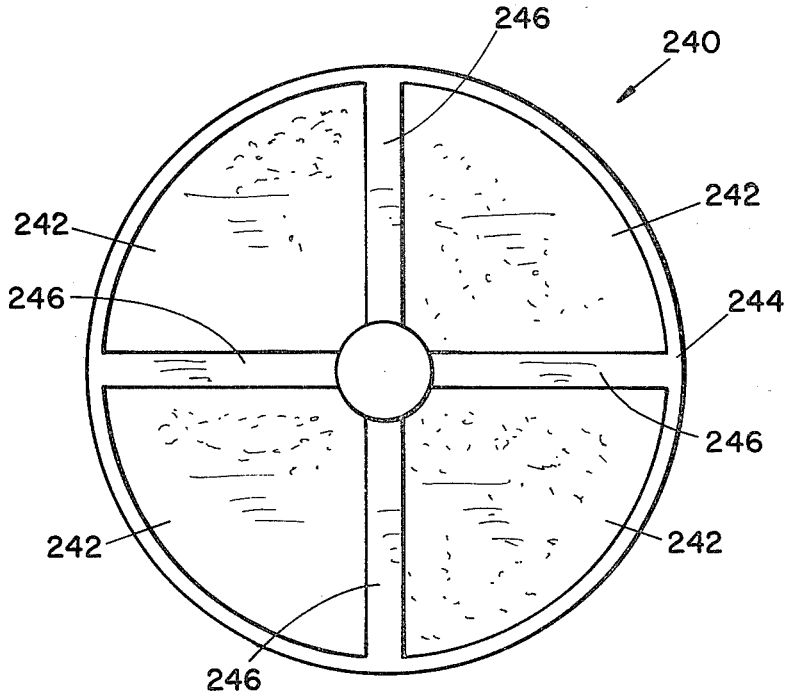
FIG. 11 is a plan view of a segmented bonded abrasive wheel.

FIG. 11 is a plan view illustrating that an abrasive member, generally indicated by the numeral 240, can be comprised of a plurality of segments 242 situated upon and within a support pan 244 which has a series of dividers 246 extending radially thereof. In this manner, damage to one of the sections 242, such as by cracking and the like, allows for replacement of the damaged sections rather than replacement of a complete 360° wheel.

Figure 12:
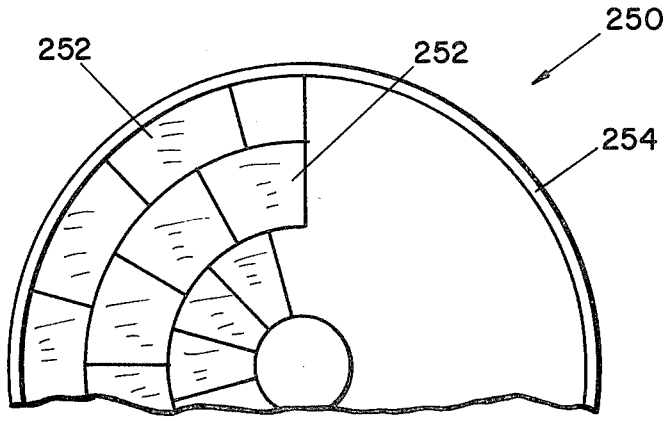
FIG. 12 is a fragmentary plan view of another form of abrasive wheel wherein a plurality of tile-like members make up the working surface of the wheel.

FIG. 12 is a plan view of a form of grinding wheel 250 wherein a plurality of tile-shaped bonded abrasive members 252 are carried by a support pan 254. Hereagain, the purpose of the plurality of abrasive members 252 is to allow replacement of damaged members rather than replacement of a complete wheel. Portions of used grinding wheels may be used in this manner rather than being discarded.

Figure 13:
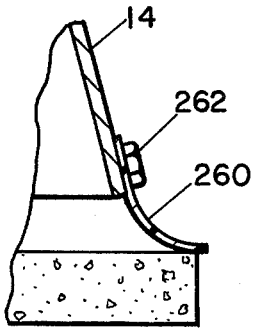
FIGS. 13–15 are fragmentary sectional views and show several forms of a flexible curtain fastened to a lower marginal edge of the tub for restricting an exit opening provided between the tub and abrasive wheel.
Figure 14:
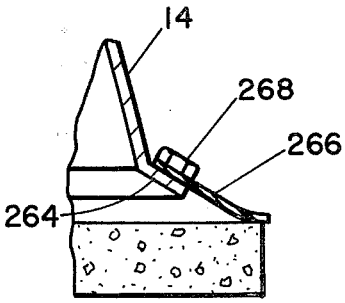
Figure 15:
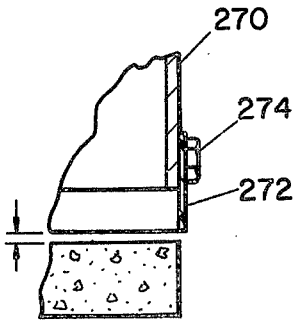

FIGS. 13–15, inclusive, each illustrate a different form of flexible curtain, such as the curtain 60 in FIGS. 1 and 3. In FIG. 13 the lower marginal portion of a tub 14 is provided with a flexible curtain 260 which is fixedly secured by a fastener 262. This arrangement causes the curtain 260 to have a considerable flex which minimizes the size of particles or small lumps which can pass through the exit opening between the tub 14 and the abrasive wheel. In FIG. 14 and tub 14 is provided with an outwardly extending flange portion 264 so that a flexible curtain 266 can be fastened thereto by a fastener 268 in a manner which provides for a small exit opening but less force, and consequently less wear, on the curtain 266.

FIG. 15 illustrates another embodiment wherein the lowermost portion of a cylindrical tub 270 has a flexible curtain 272 connected thereto by a fastener 274. The lowermost edge of curtain 272 is spaced approximately 1/16 inch (1.6 mm) above the top surface of the grinding wheel. In this form, minimum wear of the flexible curtain 272 is obtained.

Figure 16:
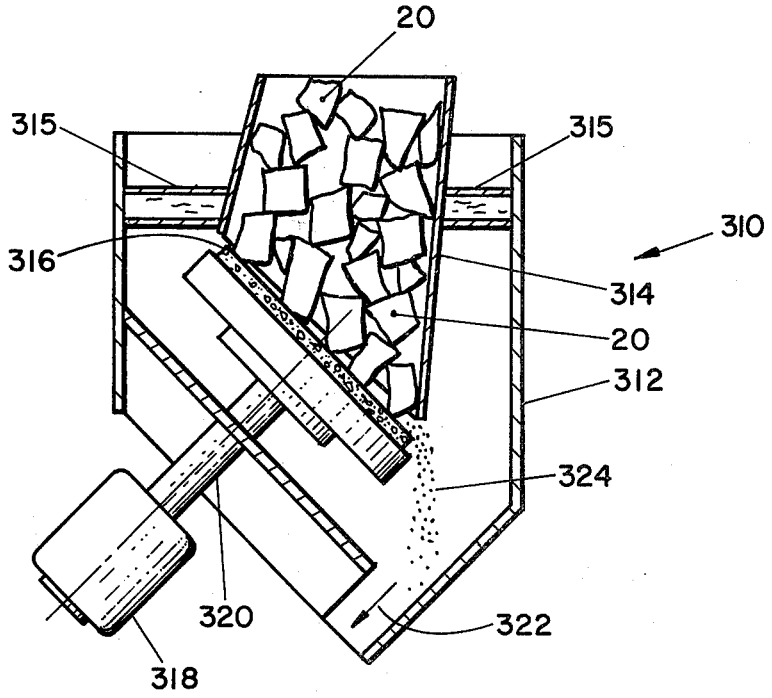
FIG. 16 is a vertical section of a modified form of the invention wherein the abrasive wheel is mounted at an angle to the horizontal so gravity minimizes or precludes bridging of lumps within the apparatus.

FIG. 16 shows a modified form of lump grinder, generally indicated by the numeral 310 which includes an outer housing 312, a lump receiving tub or container 314 held within outer housing 312 by a plurality of radially disposed support channels 315, a circular grinding wheel 316 disposed at an angle to the horizontal, a combination motor and gear reducer 318 connected to grinding wheel 316 by a drive shaft 320 and an exit port 322 for movement of a stream of particles 324 out of the housing 312. Gravity forces the lumps 20 toward the lowermost corner of tub 314 so as to provide generally full area contact with the grinding wheel 316, and wedging action causes greater pressure against the grinding wheel and thereby increases the grinding rate.

Figure 17:
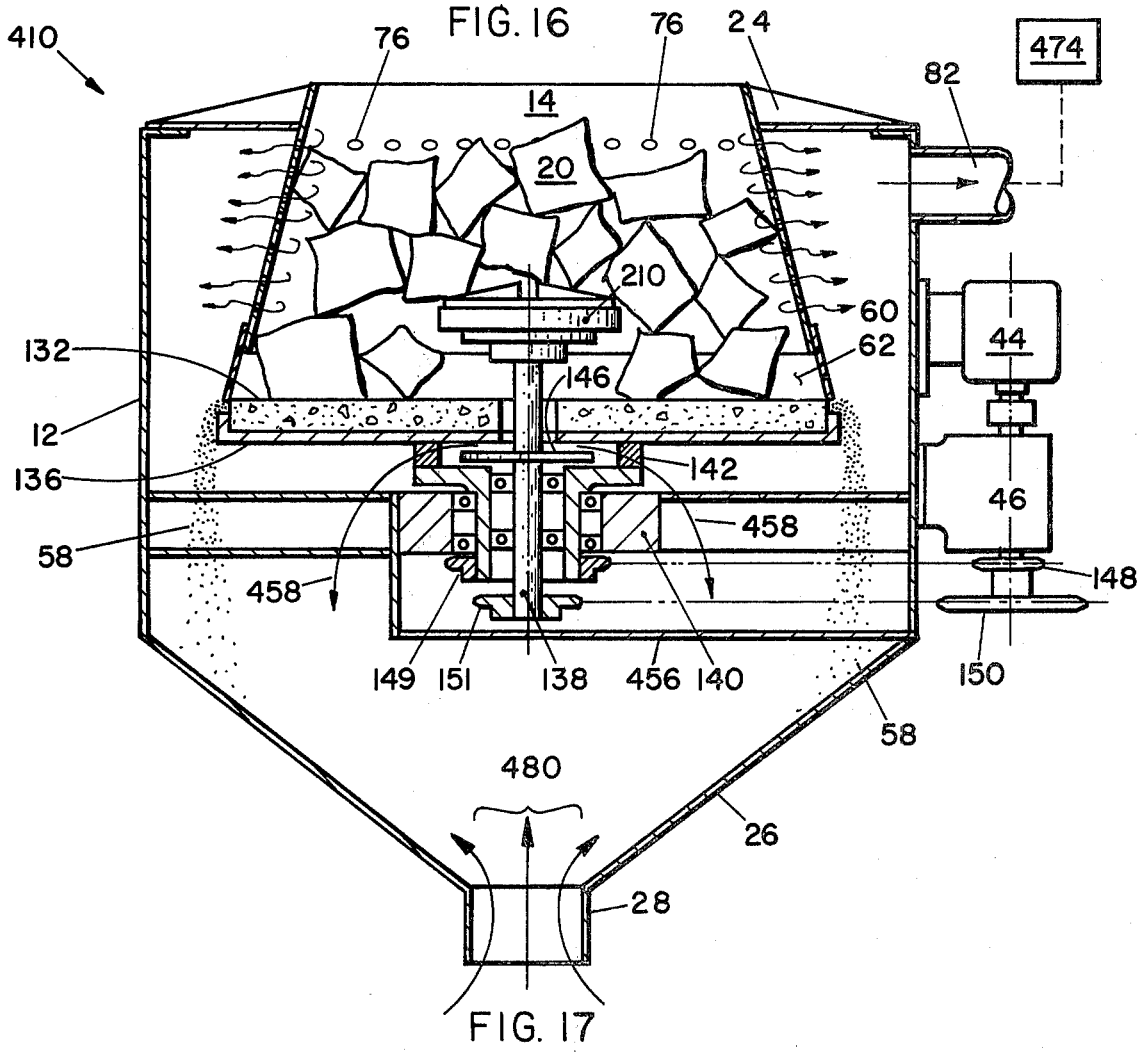
FIG. 17 is a vertical section of a still further modification of the invention and shows separate drive means to a plurality of grinding wheels, a slinger located centrally and below the grinding wheels and diagrammatically illustrates a high speed fan or blower mechanism for venting the apparatus.

FIG. 17 shows another form of lump grinder, generally indicated by the numeral 410, which is generally similar to the lump grinder 110 of FIG. 3. In order not to proliferate the description, the same numerals will be used to indicate corresponding parts as previously described above with regard to lump grinder 110. Lump grinder 410 does not utilize the air tunnels 184 and shed roof 186 as in FIG. 3 but rather supports the bearing block 140 within an enclosed housing or compartment 456. In addition, lump grinder 410 is provided with a fan or blower mechanism 474 which has a much greater capacity than the fan 74 of FIG. 3. The purpose of fan 474 is to provide much greater mass flow of air through the larger number of vent holes 76 and, particularly, through the bottom opening 28 as is indicated by the arrows 480. In the absence of the shed roof 186 of FIG. 3, the particles acted upon by the slinger 146 fall in a generally annular curtain indicated by the pair of arrows 458 and the increased air flow at 480 has an increased efficiency for removing particles of dust from the particle streams 58 and 458 as well as greater efficiency for cooling sand that may retain heat from an earlier performed casting operation.

Figure 18:
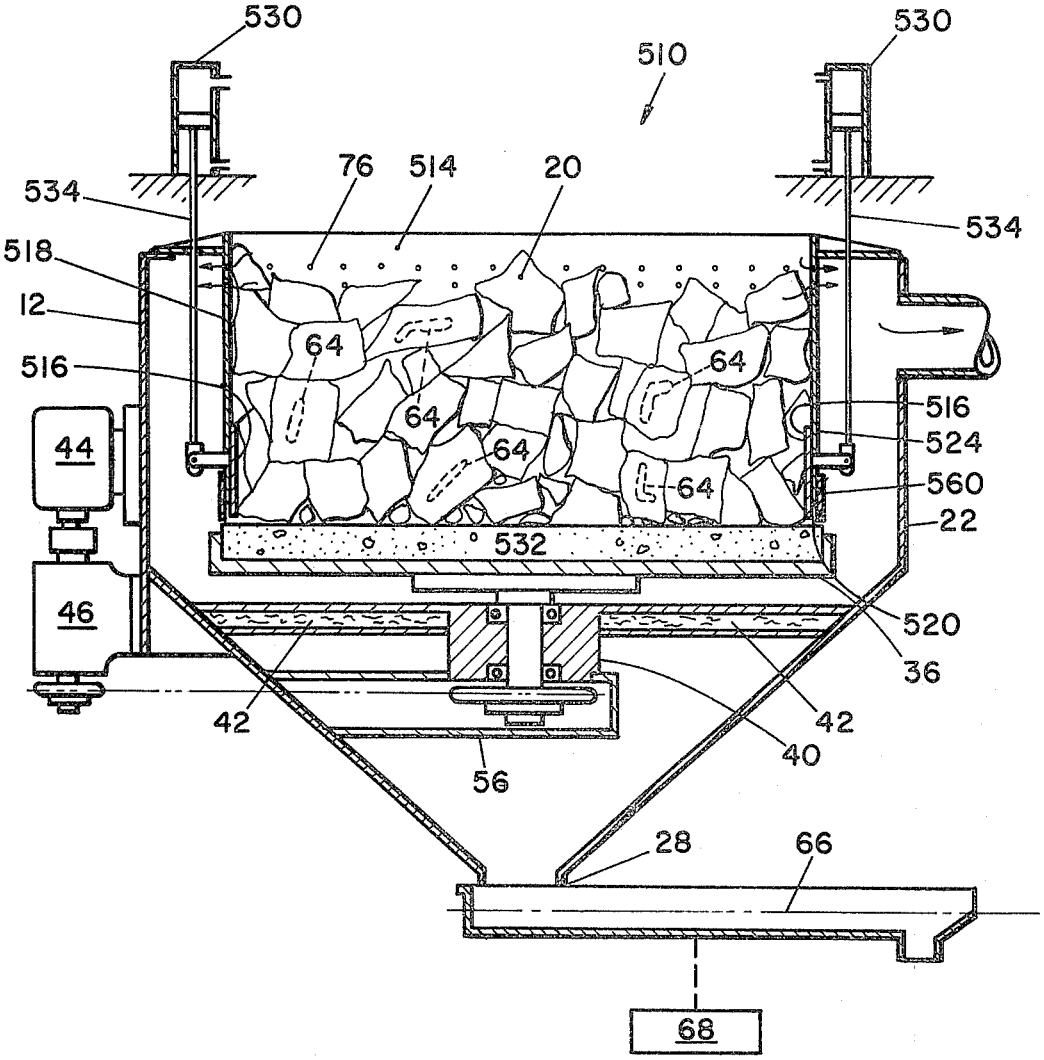
FIG. 18 is a vertical section of a further embodiment wherein the tub is shown as being cylindrical and provided with an adjustably mounted annular ring for restricting the exit space between the tub and grinding wheels.
Figure 19:
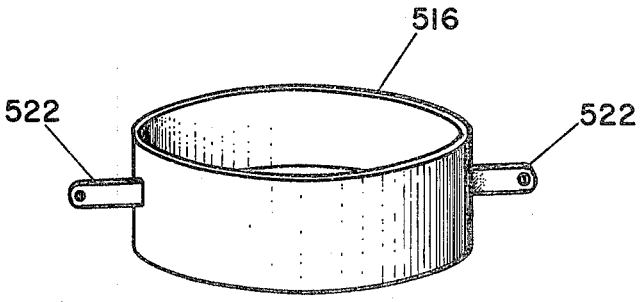
FIG. 19 is a perspective view of the annular ring used in the apparatus of FIG. 18.

FIGS. 18 and 19 show still another form of the invention wherein a lump grinder, generally indicated by the numeral 510, is similar in many respects to the lump grinder 10 shown in FIGS. 1 and 2. Hereagain, the same numerals are used to indicate similar parts. The lump grinder 510 includes a cylindrical tub 514 and a large bonded abrasive grinding wheel 532. More importantly, lump grinder 510 includes an annular ring 516 which conforms to an annular wall 518 of the tub 514 for restricting an exit space 520 located between the grinding wheel 532 and a lowermost portion of the tub 514. The annular ring 516 has a plurality of ears 522 which are welded or otherwise secured thereto and extend through open slots 524 which are vertically disposed within a lower portion of the tub 514. A pair of actuators, shown as being double acting fluid motors 530, are connected to the ears 522 by piston rods 534 for raising and lowering the ring 516 to vary the size of exit space 520. Other types of actuators, such as screw jacks, may be used in place of fluid motors 530. As previously mentioned, lumps of sand used in foundry operations often contain support rods 64 which are used to strengthen the molds during pouring of molten metal. The rods 64 can be retained within the tub 514 by lowering ring 516 until it is closely adjacent to the grinding wheel 532. After all of the sand lumps have been reduced to particles the ring 516 is raised by fluid motors 530 and all rods 64 are removed from the tub 514 by centrifugal force which causes the rods 64 to flex the curtain 560 and allow the rods 64 to be collected at bottom opening 28.

It will be apparent from the foregoing that various modifications of a preferred embodiment of the invention have been described in detail and it is to be understood that other changes may be made by those skilled in the art within the scope of the invention as defined by the appended claimed subject matter.

We claim:

1. Apparatus for reducing lumps of material to particles, said apparatus comprising a tub including an annular wall, an upper opening in said tub for receiving lumps of material and a lower opening for discharging particles from said tub; abrasive means located adjacent said lower opening for coming into rubbing contact with lumps of material, drive means for driving said abrasive means for abrading said lumps of material into particles, said abrasive means being spaced from said annular wall for providing an exit space for allowing particles to exit from said tub, said apparatus further including an outer housing substantially enclosing said tub except for said upper opening, and means for creating a flow of air into said upper opening and into said outer housing for ventilating said tub.

2. Apparatus as defined in claim 1 wherein said particles flow from said exit space to form a curtain-like stream of particles, and said means for creating a flow of air causes air to flow through said stream.

3. Apparatus for reducing lumps of material to particles, said apparatus comprising a tub including an annular wall, an upper opening in said tub for receiving lumps of material and a lower opening for discharging particles from said tub; abrasive means located adjacent said lower opening for coming into rubbing contact with lumps of material, drive means for driving said abrasive means for abrading said lumps of material into particles, said abrasive means being spaced from said annular wall for providing an exit space for allowing particles to exit from said tub, and said abrasive means being comprised of a bonded abrasive grinding wheel.

4. Apparatus as defined in claim 3 including means restricting said exit space for limiting the size of material that can pass through said exit space.

5. Apparatus as defined in claim 4 wherein said means for restricting said exit space is comprised of means mounting said abrasive means and said tub in closely spaced relation to each other.

6. Apparatus as defined in claim 4 wherein said means for restricting said exit space is comprised of a flexible curtain disposed across said exit space.

7. Apparatus as defined in claim 6 including means for fixedly securing said flexible curtain to said annular wall of said tub.

8. Apparatus as defined in claim 4 wherein said means for restricting said exit space is comprised of an annular ring generally conforming to said annular wall, and means for moving said annular ring relative to said annular wall for increasing and reducing the size of said exit space.

9. Apparatus as defined in claim 8 wherein said means for restricting said exit space further includes a flexible curtain disposed across said exit space.

10. Apparatus as defined in claim 9 including means telescopically mounting said annular ring within said tub adjacent to said annular wall, and means mounting said flexible curtain to the outside of said tub.

11. Apparatus as defined in claim 3 wherein said bonded abrasive grinding wheel is disposed substantially completely across said lower opening at an angle to the horizontal for causing lumps of material to wedge between said tub and said abrasive grinding wheel for increasing the grinding rate.

12. Apparatus for reducing lumps of material to particles, said apparatus comprising a tub including an annular wall, an upper opening in said tub for receiving lumps of material and a lower opening for discharging particles from said tub; abrasive means located adjacent said lower opening for coming into rubbing contact with lumps of material, drive means for driving said abrasive means for abrading said lumps of material into particles, said abrasive means being spaced from said annular wall for providing an exit space for allowing particles to exit from said tub, said abrasive means including a support pan, means connecting said support pan to said means for rotating said abrasive means, and bonded abrasive means carried by said support pan.

13. Apparatus as defined in claim 12 wherein said bonded abrasive means is comprised of a bonded abrasive grinding wheel.

14. Apparatus as defined in claim 12 wherein said bonded abrasive means is comprised of segments of a grinding wheel.

15. Apparatus as defined in claim 12 wherein said bonded abrasive means is comprised of a plurality of tile-shaped members arranged closely adjacent to each other and covering said support pan.

16. Apparatus for reducing lumps of material to particles, said apparatus comprising a tub including an annular wall, an upper opening in said tub for receiving lumps of material and a lower opening for discharging particles from said tub; abrasive means located adjacent said lower opening for coming into rubbing contact with lumps of material, drive means for driving said abrasive means for abrading said lumps of material into particles, said abrasive means being spaced from said annular wall for providing an exit space for allowing particles to exit from said tub, said abrasive means including an outer portion located closely adjacent to said annular wall and an inner portion raised above said outer portion, said outer portion being separate from said inner portion, and said drive means includes separate means for rotating said outer portion and said inner portion at different angular velocities.

17. Apparatus for reducing lumps of material to particles, said apparatus comprising a tub including an annular wall, an upper opening in said tub for receiving lumps of material and a lower opening for discharging particles from said tub; abrasive means located adjacent said lower opening for coming into rubbing contact with lumps of material, drive means for driving said abrasive means for abrading said lumps of material into particles, said abrasive means being spaced from said annular wall for providing an exit space for allowing particles to exit from said tub, said abrasive means including a relatively large abrasive wheel means and a small abrasive wheel means, and means mounting said small abrasive wheel means above said large abrasive wheel means.

18. Apparatus as defined in claim 17 including means for eccentrically mounting said small abrasive wheel means relative to said large abrasive wheel means.

19. Apparatus as defined in claim 17 wherein said drive means includes separate means for rotating said small abrasive wheel means and said large abrasive wheel means at different rotational velocities.

20. Apparatus as defined in claim 19 wherein said large abrasive wheel means is an annular wheel having an opening therein for providing a passage for said particles, and slinger means located below said opening for impelling particles outwardly therefrom.

* * * * *